US007338359B2

(12) United States Patent
Grossman et al.

(10) Patent No.: US 7,338,359 B2
(45) Date of Patent: Mar. 4, 2008

(54) STRUCTURAL ROOF VENTING SYSTEM FOR GRAIN BIN AND ASSOCIATED METHOD

(75) Inventors: Rodney B. Grossman, Goshen, IN (US); Mark S. Dingeldein, Milford, IN (US); Justin Holmes, Valparaiso, IN (US)

(73) Assignee: CTB IP, Inc., Wilmington, DE (US)

( * ) Notice: Subject to any disclaimer, the term of this patent is extended or adjusted under 35 U.S.C. 154(b) by 0 days.

(21) Appl. No.: 11/268,720

(22) Filed: Nov. 7, 2005

(65) Prior Publication Data

US 2006/0116068 A1 Jun. 1, 2006

Related U.S. Application Data

(60) Provisional application No. 60/627,918, filed on Nov. 15, 2004.

(51) Int. Cl.
*F24F 7/00* (2006.01)

(52) U.S. Cl. ..... 454/365; 454/366; 454/367; 34/233

(58) Field of Classification Search ..... 454/365, 454/182; 34/233
See application file for complete search history.

(56) References Cited

U.S. PATENT DOCUMENTS 718,657 A 1/1903 Renton
1,977,391 A * 10/1934 Kramer ..... 454/182
2,741,972 A 4/1956 Pryne
3,092,472 A 6/1963 Figley
4,004,352 A 1/1977 Steffen
4,009,520 A 3/1977 Sukup
4,020,565 A 5/1977 Steffen
4,077,134 A 3/1978 Steffen
4,192,107 A 3/1980 Wickstrom et al.
4,319,411 A 3/1982 Steffen
4,480,534 A 11/1984 Sloan
4,498,373 A 2/1985 Dittmer et al.
4,625,630 A 12/1986 Carroll et al.
4,872,398 A 10/1989 Shen
4,885,985 A * 12/1989 Pollock ..... 454/182
5,020,246 A 6/1991 Rust et al.
5,344,363 A 9/1994 Pollock
5,603,657 A * 2/1997 Sells ..... 454/359
5,632,674 A 5/1997 Miller, Jr.

* cited by examiner

*Primary Examiner*—Steven B. McAllister
*Assistant Examiner*—Samantha A. Miller
(74) *Attorney, Agent, or Firm*—Harness, Dickey & Pierce, P.L.C.

(57) ABSTRACT

A roof system for a grain storage structure. The roof system includes a plurality of enclosures defined between adjacent roof panel surfaces. Each enclosure includes opposed exterior and interior wall segments oriented at an angle relative to the panel surfaces.

12 Claims, 7 Drawing Sheets

STRUCTURAL ROOF VENTING SYSTEM FOR GRAIN BIN AND ASSOCIATED METHOD

CROSS-REFERENCE TO RELATED APPLICATIONS

This application claims the benefit of U.S. Provisional Application No. 60/627,918, filed on Nov. 15, 2004. The disclosure of the above application is incorporated herein by reference.

INTRODUCTION

Harvested grain may be dried and stored for extended lengths of time in grain silos or grain bins, because of fluctuating market conditions. Additionally, moist grain may be held in bins and then heated with forced air to extract the moisture. Grain bins typically include a cylindrical body and a conical roof. The body can be a peripheral wall typically comprised of bolted or welded, smooth or corrugated wall panels. The conical roof can have a 20-40 degree slope, and is typically comprised of pie-shaped or radial roof panels with integrated ribs or stiffeners along the two long sides of the panels. These ribs provide strength and stiffness to the panels, allowing them to span between the storage structure's walls and a fill hole collar or to intermediate structural elements located beneath or above the panels.

Grain is typically loaded into these structures through a fill hole at the top of the roof and unloaded via an under floor auger system accessed through operable floor sumps. Because grain may be stored for a relatively long time, methods for preserving the condition of the grain against moisture, temperature, and insects are used. To aid in preserving grain against moisture, grain storage structures typically employ an under floor aeration system, utilizing fans which distribute air horizontally through a plenum space, vertically through a perforated floor into the grain mass, and out through vents located in the roof of the structure. For this function, the roof vents provide a critical outlet for the created pressure, the absence of which could result in excessive stress and damage to the roof structure and containment of moisture limiting the effectiveness of the grain bin. To aid in preserving grain against the negative effects of high ambient air temperatures that tend to occur at the inside peak of the roof, roof vents are again utilized, relieving the build-up of hot air by means of natural convection.

While roof venting is desired and even necessary during some processes of conditioning grain, roof vents can be detrimental in other processes. Grain must also be preserved against insects, which can enter the storage structure as larvae during loading, or as flying insects through vent screens. The typical method to remedy this problem is fumigation of the storage container. This process is performed within the container and requires that the container be reasonably airtight. Roof vents must be sealed in some way prior to fumigating, a process that can take substantial time and often poses some safety risk. In addition to the fumigation process, roof vents also must often be closed during the grain loading process. During grain loading, substantial grain dust is generated which can escape through roof vents and settle on surrounding structures. Many municipalities require that grain storage facilities located within town limits prevent the migration of grain dust during loading.

Typically, roof venting systems include a series of roof panels located at regular radial intervals, with a single hole cut in the flat portion between the integrated ribs, and capped with a metal shroud which allows air to escape while preventing rain or snow from entering into the container. The metal shrouds are comprised of multiple parts and are fastened to the roof panel in the field during the construction of the storage structure. The number and frequency of vented panels varies based on the container's capacity, fan output, climate, and other venting requirements. Because of the size of the vent hole and shroud, the pie shape of the roof panels, and the natural convergence of the integrated ribs towards the top of the container's roof peak, the vent hole in the vented panels is typically located in the end of the panel nearest to the container's wall. This location is not ideal, as the heated air that desires relief by natural convection, is located at the peak of the roof, not the eave.

Existing vents can be expensive and time-consuming to install, can often leak because of difficulties in installation, can trap material, and can lead to rusting around the vents. There is, therefore, a need for improved venting systems for grain bins.

SUMMARY

The present teachings provide a roof system for a grain storage structure. The roof system includes a plurality of panels defining a roof, wherein adjacent panels overlap forming structural stiffeners therebetween. Each stiffener defines an enclosure, desirably an enclosed channel or chamber, and preferably a box-like enclosure, and includes first and second wall segments. The roof system also includes a plurality of vents defined on the first and second wall segments for guiding moisture away from the grain storage structure and into or through the box-like enclosure.

The present teachings also provide a roof system for a grain storage structure that includes a plurality of enclosures defined between adjacent roof panel surfaces. Each enclosure includes opposed exterior and interior wall segments oriented at an angle relative to the roof panel surfaces.

The present teachings provide a method for venting a roof system of a grain storage structure. The method includes overlapping adjacent roof panels, forming a plurality of enclosures between the overlapping adjacent roof panels, and defining a venting path through each enclosure from interior to exterior wall segments of the enclosures.

Further areas of applicability of the present invention will become apparent from the description provided hereinafter. It should be understood that the description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF VARIOUS ASPECTS

The following description is merely exemplary in nature and is in no way intended to limit the invention, its application, or uses. For example, although a grain bin is illustratively described, the present teachings are not limited to grain bins, but can be used for any storage containers of bulk granular material.

Figure 1:
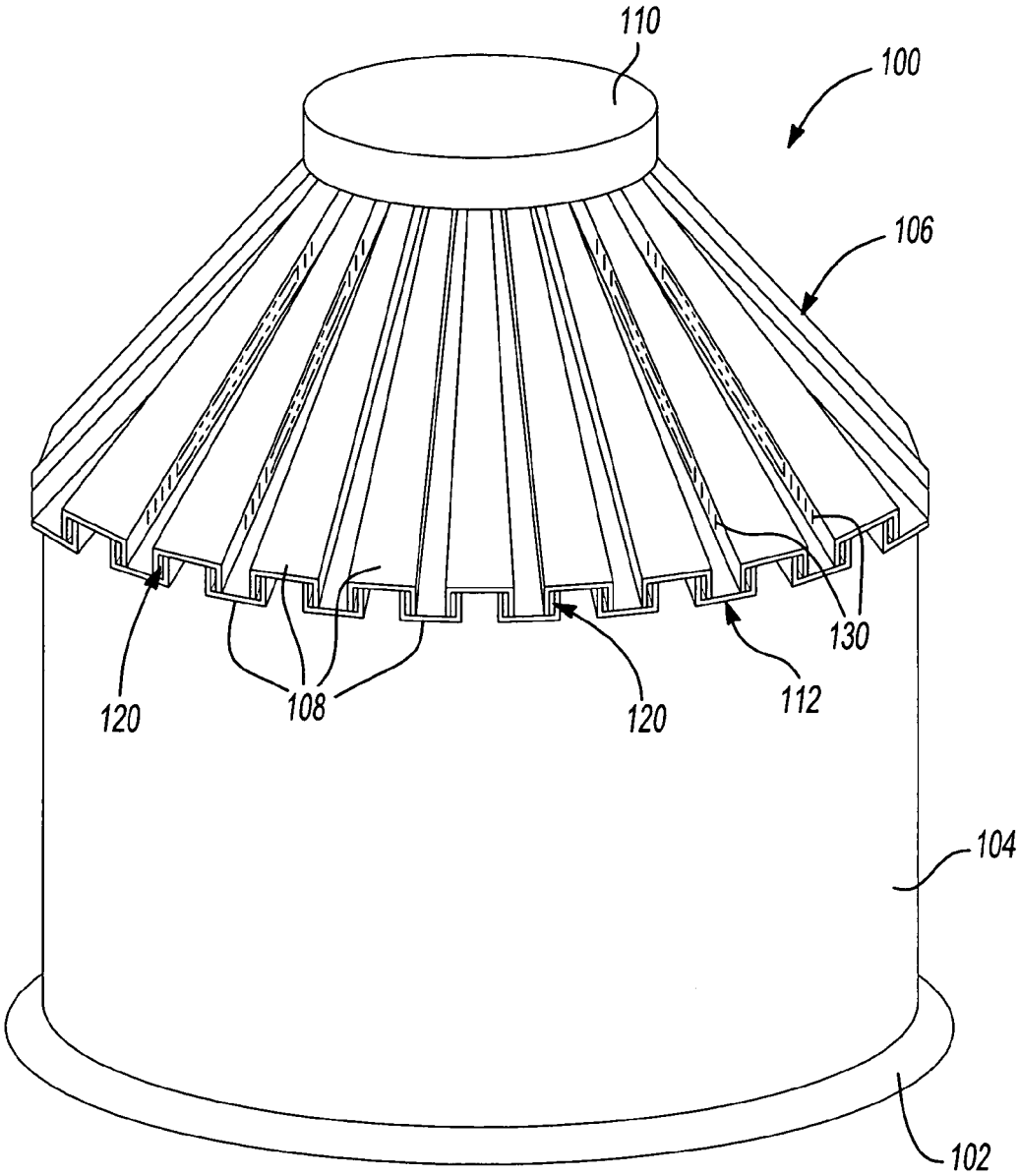
FIG. 1 is a perspective view of a grain bin with a roof system according to the present teachings.

Referring to FIG. 1, an exemplary granular material storage container 100 according to the present teachings, illustrated as a grain bin, may include a foundation 102, a wall 104 having an upper periphery or eave 112, and a roof system 106 extending from a peak 110 to the upper periphery 112. The roof system 106 can be substantially conical and can include a plurality of radial panels 108 extending from the peak 110 to the upper periphery 112, a plurality of a radial stiffeners 120, and a plurality of vents 130. The radial stiffeners 120 can be integral with the panels 108, and the vents 130 can be integral with the stiffeners 120.

Figure 2A:
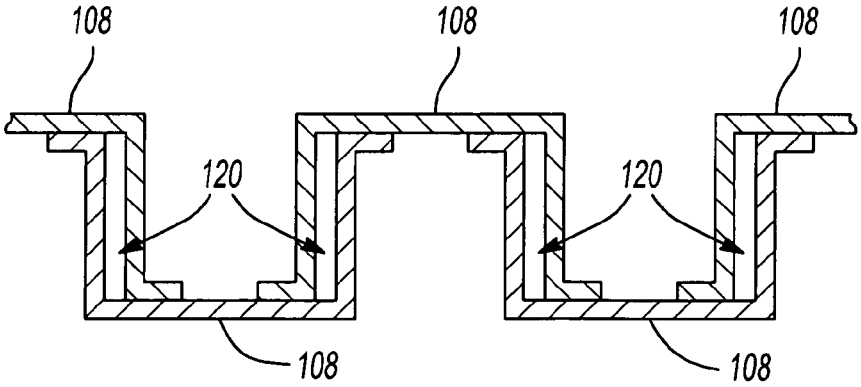
FIG. 2A is a schematic partial side view of roof system according to the present teachings showing a meandering panel arrangement.
Figures 2, 3:
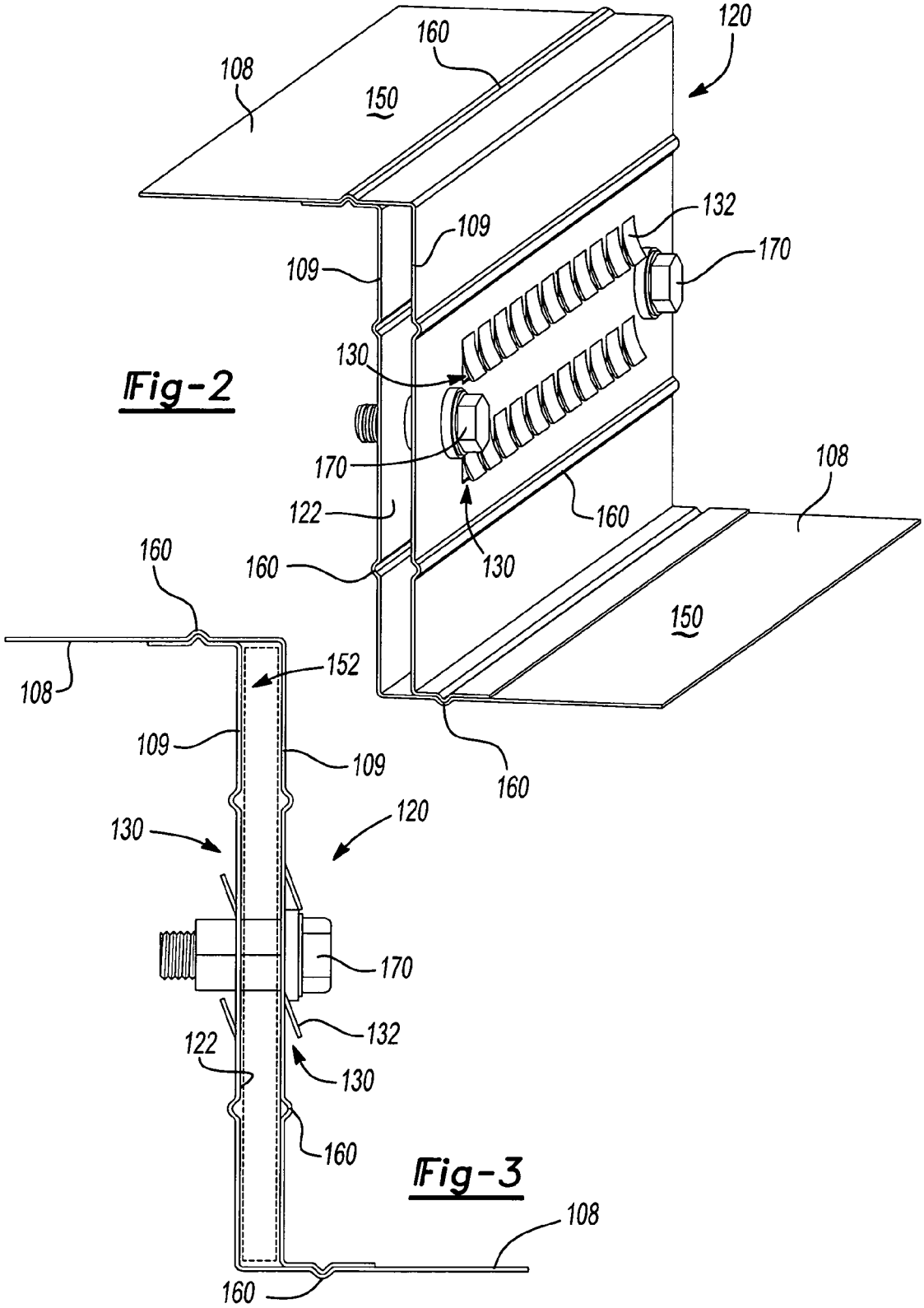
FIG. 2 is a perspective view of a stiffener integrated with a venting system according to the present teachings.
FIG. 3 is a side view of a stiffener integrated with a venting system according to the present teachings.
Figure 5:
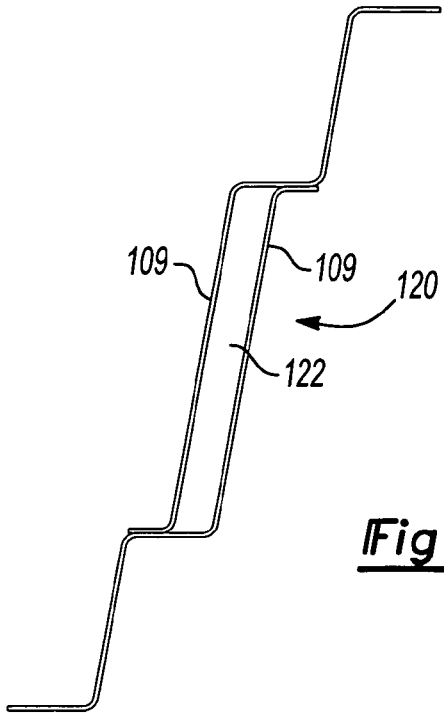
FIG. 5 is a side view of a stiffener according to the present teachings.
Figure 9:
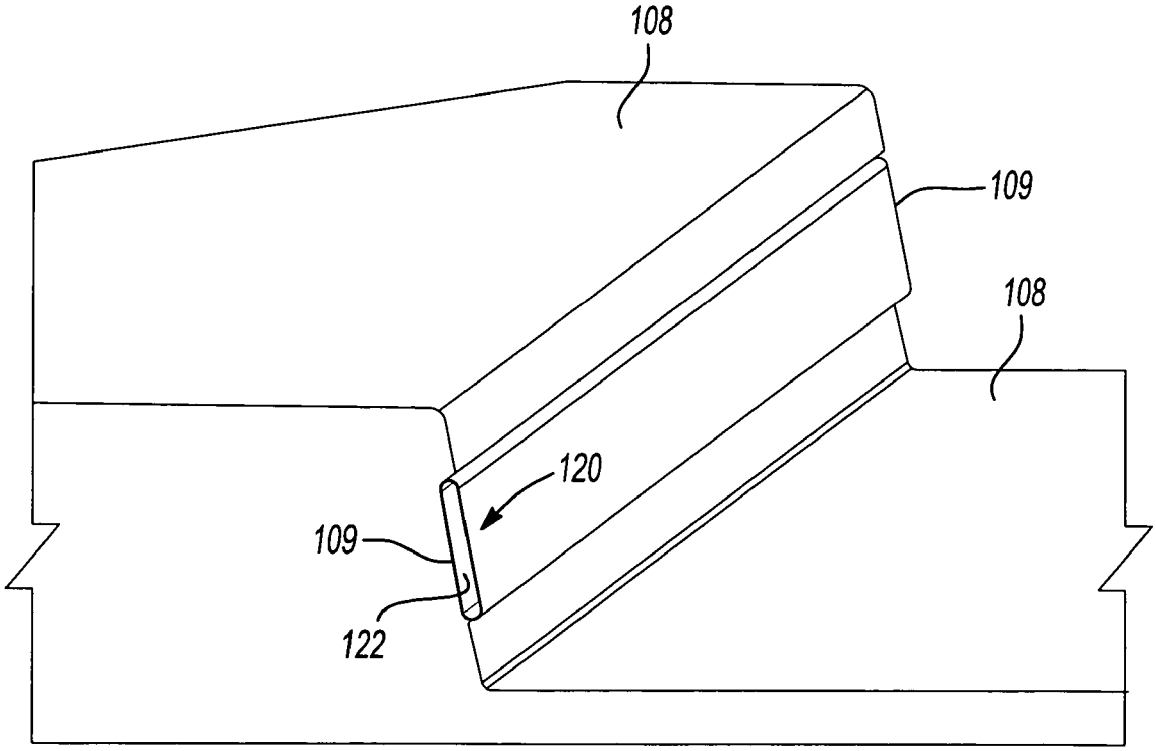
FIG. 9 a perspective view of a stiffener according to the present teachings.

Referring to FIGS. 2 and 3, an exemplary pair of adjacent panels 108 can include overlapping opposed exterior and interior wall segments 109 defining a stiffener 120. The overlapping wall segments 109 can be secured against movement at various intervals with bolts or other fasteners 170. The overlapping wall segments 109 can be oriented at an angle, such as a substantially 90 degree angle, relative to surfaces 150 of the panels 108. The stiffener 120 defines a load-bearing structural enclosure 122 in the form of a chamber or enclosed channel. The enclosure 122 is at least in part defined by the two exterior and interior wall segments 109. It will be appreciated that the enclosure 122 can be box-like and have corners that define angles other than 90 degrees, and that the corners can be sharp or rounded. The enclosure 122 can extend along the entire length and width of the overlapping wall segments 109 between the panels 108, as illustrated in FIGS. 2 and 3. In another aspect, the overlapping wall segments 109 can be formed such that the enclosure 122 can occupy only a portion of the width thereof, as illustrated in FIGS. 5 and 9.

Figure 8:
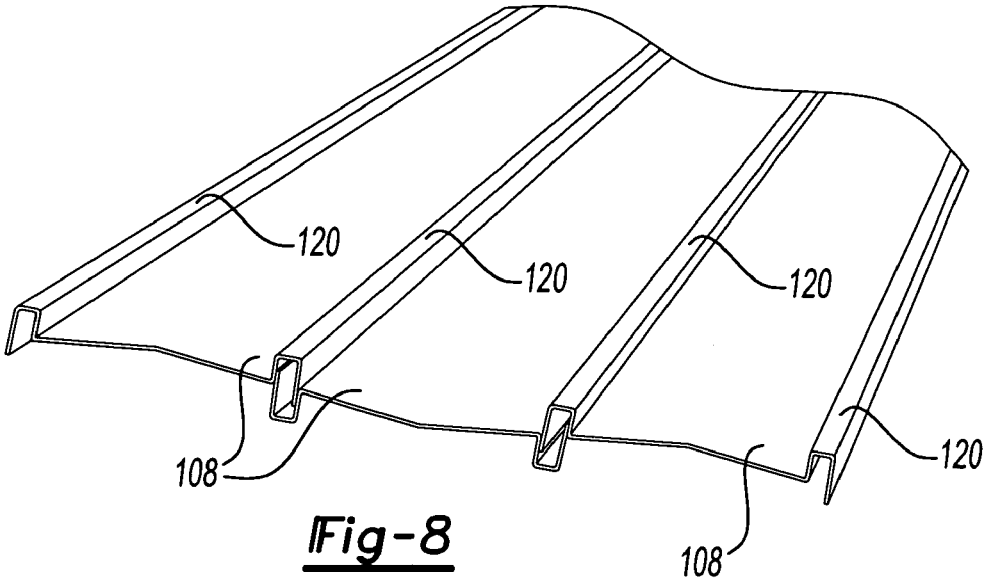
FIG. 8 is a perspective view of a portion of a roof system according to the present teachings.

Adjacent panels 108 can overlap such that the stiffeners 120 extend at an angle between unequally leveled adjacent panel surfaces 150, such that the panels 108 form a meandering surface, as illustrated in FIGS. 2 and 2A. The stiffeners 120 can also be defined to be centered about equal level adjacent panel surfaces 150, as illustrated in FIGS. 8 and 6.

Figure 3A:
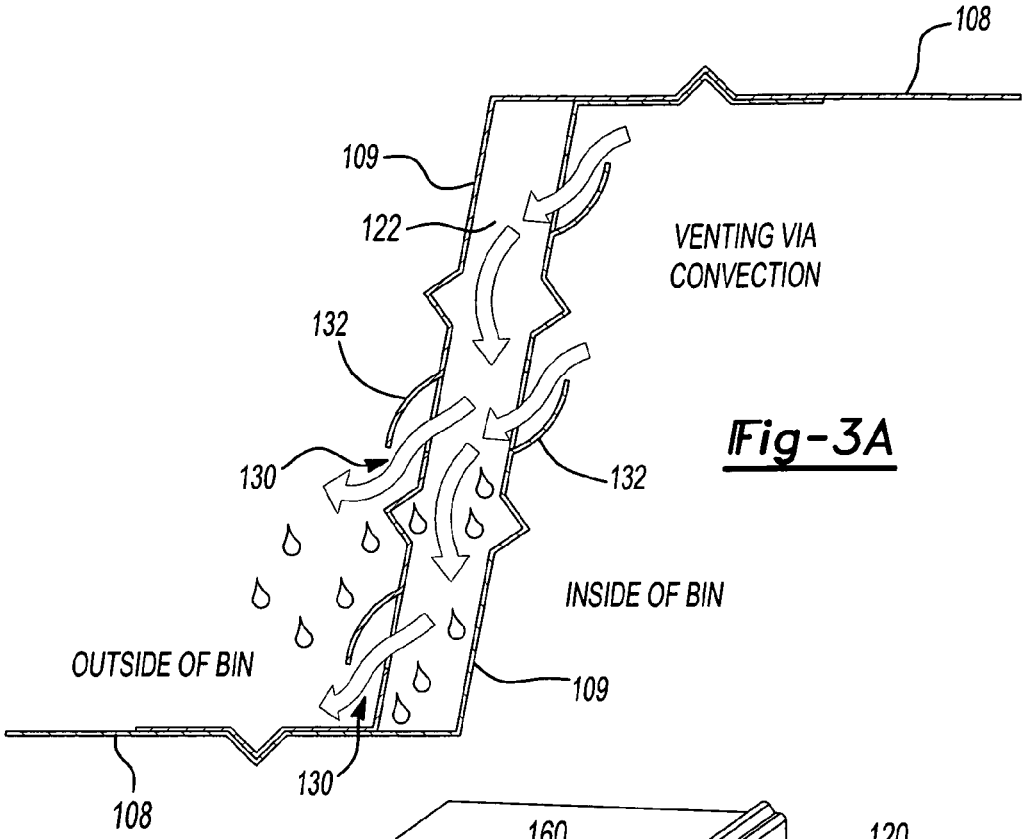
FIG. 3A is a side view of a stiffener integrated with a venting system according to the present teachings.
Figure 4:
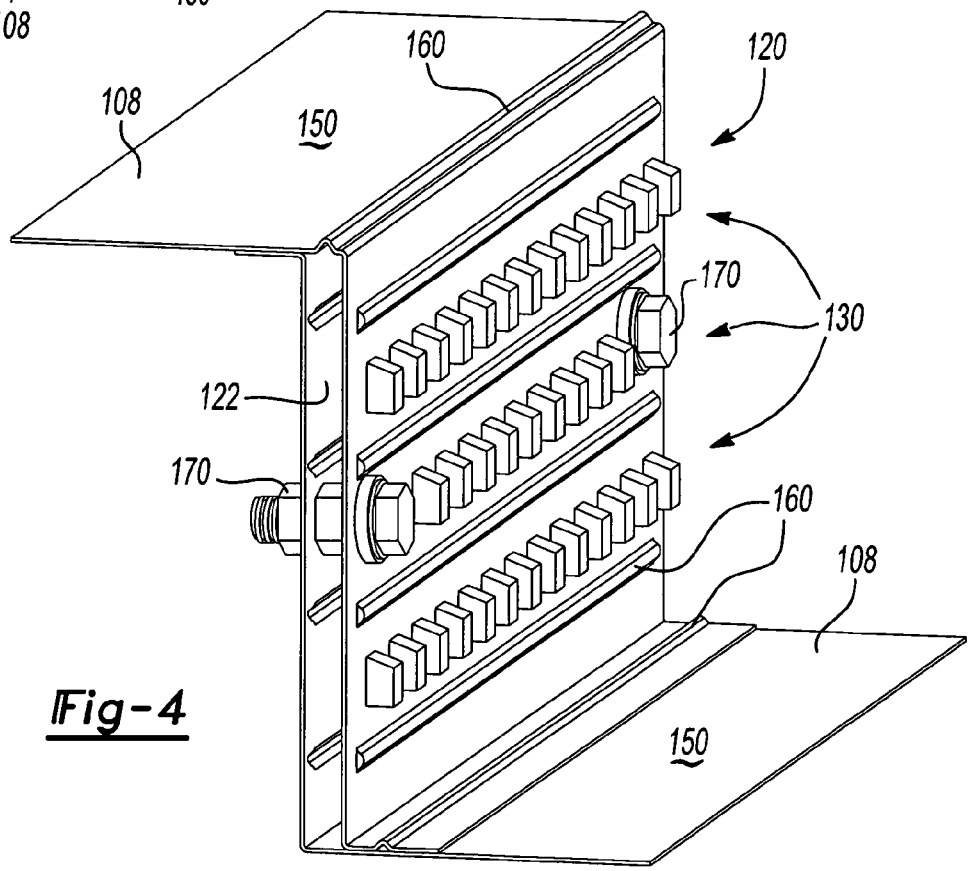
FIG. 4 is a perspective view of a stiffener integrated with a venting system according to the present teachings.

Referring to FIGS. 2-4, a venting system comprising a plurality of vents 130 can be integrated with the stiffeners 120. In particular, the opposed exterior and interior wall segments 109 of the enclosure 122 can define vents 130 with openings having flaps or louvers 132. The louvers 132 of one of the wall segments 109 can be offset relatively to the louvers of the other of the wall segments 109, as illustrated in FIG. 3A. The louvers 132 can be configured such that a substantially one-way venting path, illustrated by arrows, is defined from the interior of the storage container 100 through the enclosure 122 to the exterior of the storage container 100. Further, the louvers 132 can be configured such that moisture from the interior is trapped into the enclosure or led outside the storage container 100, and is prevented from re-entering the interior of the storage container. The louvers 132 can be configured, for example, as moisture collectors facing toward the roof ceiling in the interior of the storage container 100, and as moisture deflectors facing in the opposite direction in the exterior of the storage container 100, as illustrated in FIG. 3A. The vents 130 can be arranged serially in one or more rows along the length (radial extent) of the stiffeners 120.

Figure 4A:
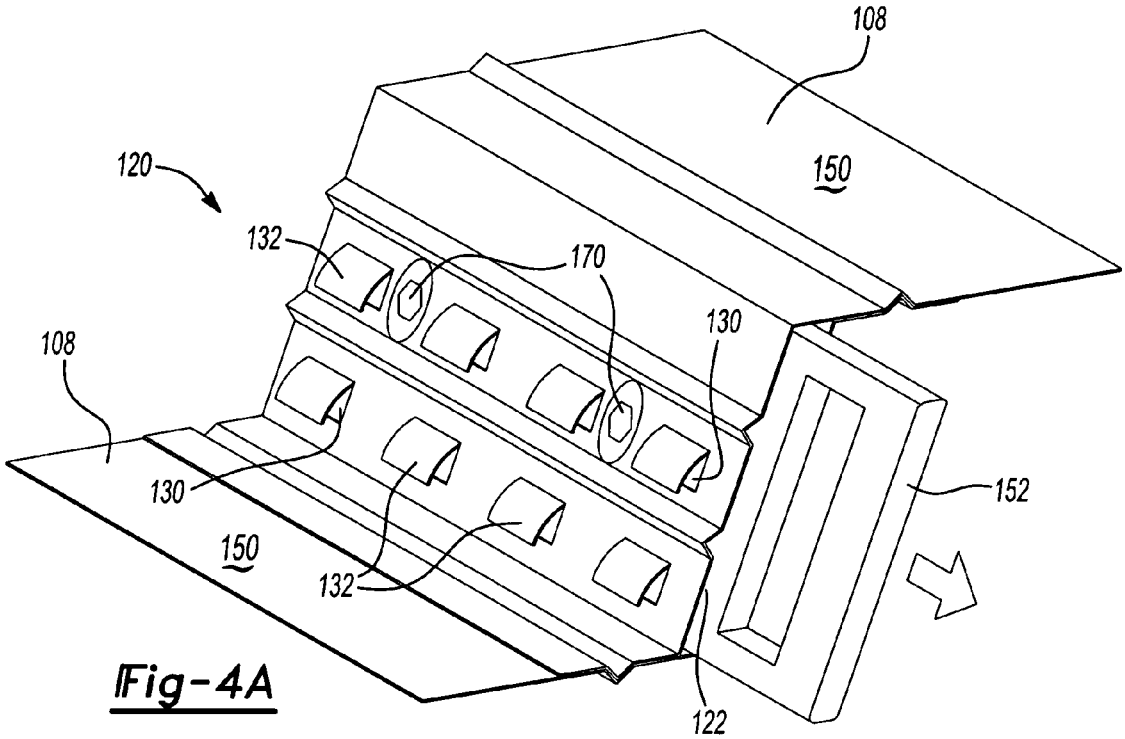
FIG. 4A is a perspective view of a stiffener integrated with a venting system according to the present teachings, the venting system shown in an open position.
Figure 4B:
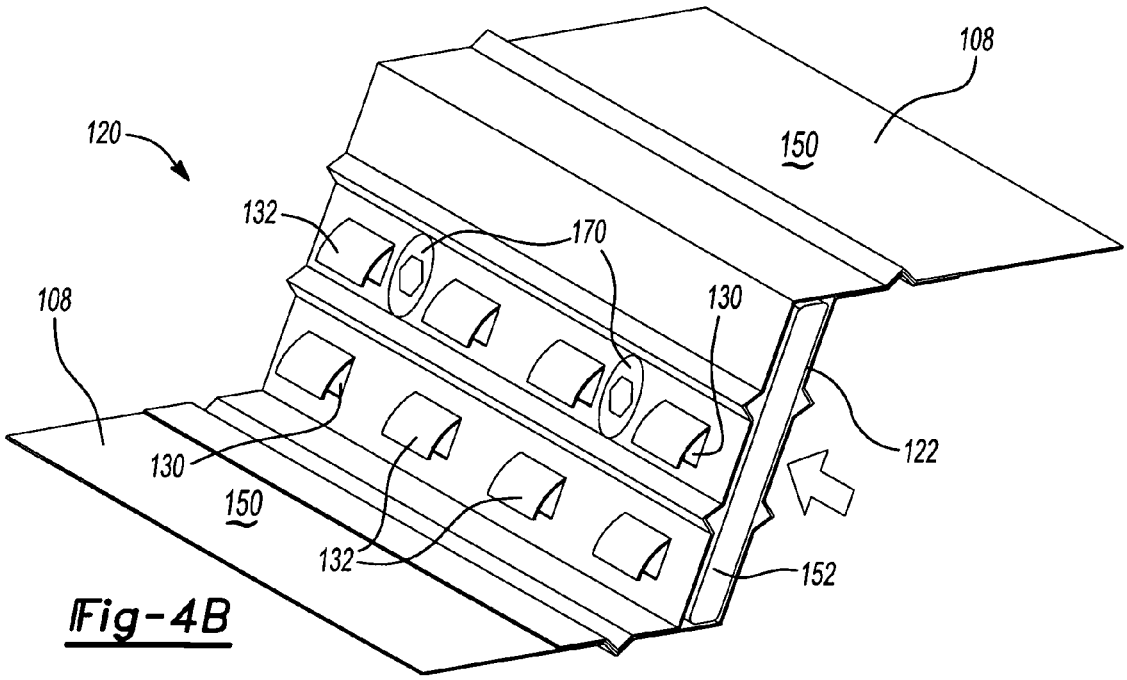
FIG. 4B is a perspective view of a stiffener integrated with a venting system according to the present teachings, the venting system shown in a closed position.

Referring to FIGS. 4A and 4B, a sliding element 152 can be housed inside the enclosure 122 and slidably moved between a first position in which the vents 130 are open and a second position in which the vents 130 are closed. The sliding element 152 can be provided with openings of equal spacing and alignment to the openings of the vent 130 along the length of the stiffeners 120. Each sliding element 152 can be moved parallel to the corresponding stiffener 120 for blocking the vent openings, thereby closing the vents 130 and sealing the grain bin 100. This operation can be performed from a single location, such as the roof peak 110, or from a remote ground location.

Figure 6A:
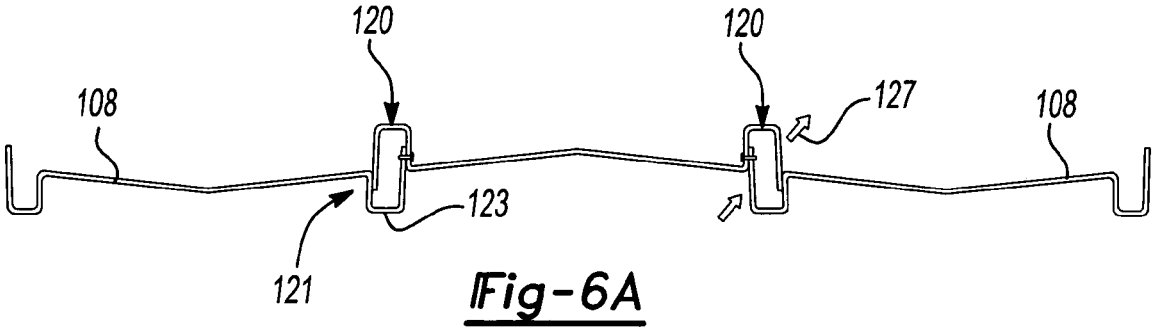
FIG. 6A is a schematic diagram of moisture and air flow details for a roof system according to the present teachings.
Figure 6B:
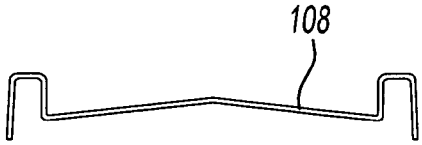
FIG. 6B is a schematic diagram of stiffening details for a roof system according to the present teachings.

In another aspect, referring to FIG. 6A, the panels 108 can be shaped to channel water away from weak joints 121 in the stiffeners 120. A weep pan 123 can provide escape for infiltrating moisture. The folded and corrugated style of the panels 108 can provide additional stiffness, as illustrated in FIG. 6B. Air flow through the stiffeners 120 is indicated at 127.

Figure 7A:
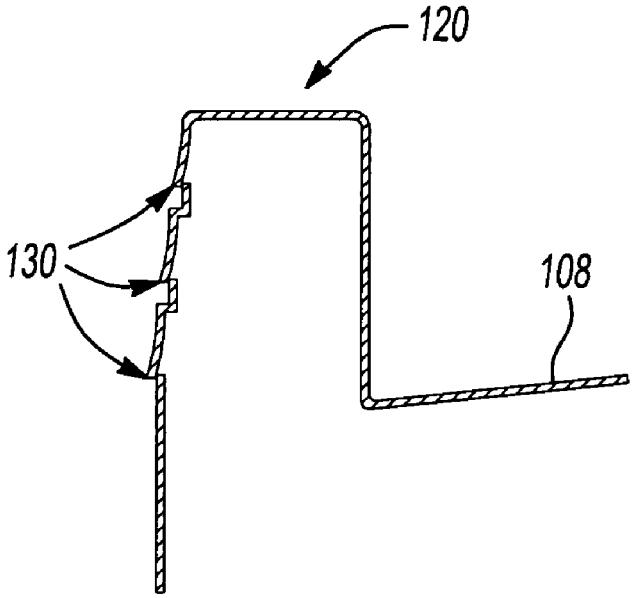
FIG. 7A is a schematic diagram of venting details for a roof system according to the present teachings.
Figure 7B:
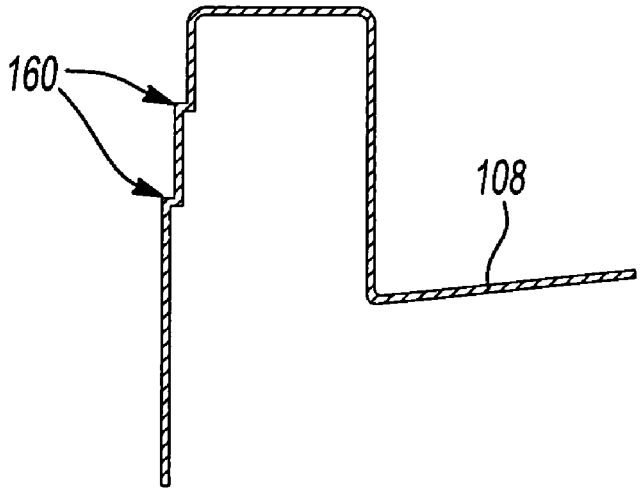
FIG. 7B is a schematic diagram of stiffening details for a roof system according to the present teachings.

Referring to FIG. 7A, in another aspect the vents 130 can be formed with hawk-cut air inlets/outlets along the length of the stiffener 120. Small corrugations 160 can also be provided to increase strength as illustrated in FIG. 7B.

Accordingly, the panels 108 of the roof system 106 integrate structural load-carrying double-walled stiffeners 120 defining an enclosure 122 between opposed exterior and interior walls 109, and an air venting system with air vents 130 having offset louvers 132 and a vent closing sliding element 152. The vents 130 can be arranged such that airflow occurs through the vents 130 along the entire length of the stiffeners 120. Further, the vents 130 can be arranged such that the venting area increases linearly from the eave 112 to the peak 110 of the roof system 106. The vents 130 can be configured such that moisture from the top of roof system 106 is prevented from passing through the vents 130.

The double-walled structural stiffeners 120 can be arranged to create a chamber-like enclosure 122 in which the operable vent closing sliding element 152 is housed. Moisture/condensation may be channeled off away from the interior roof system 106 through the chamber 122. The sliding element 152, which is optional, can be used to close the vents 130 and prevent grain dust migration and seal grain bin or silo during insect fumigation process.

It will be appreciated that the double-walled stiffeners 120 with their box-like enclosures 122 provide increased strength for fixed use of material, thereby improving the efficiency of the roof system 106. The overlapping interior and exterior wall segments 109 with the offset louvers 132 prevent moisture infiltration into the storage container 100 from blowing rain or snow. Further, any moisture blown into the enclosure 122 is trapped into the enclosure 122, migrates down the roof panels 108 and exits at the eave 112.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for venting a roof system of a grain storage structure comprising:

overlapping each edge of a plurality of substantially similar roof panels with another of the substantially similar roof panels;

forming the plurality of substantially similar roof panels with edges that cooperate to define a plurality of enclosures between the overlapping roof panels; and forming the plurality of substantially similar roof panels with openings that define a venting path through each enclosure from an interior wall segment to an exterior wall segment of the enclosures.

2. The method of claim 1, further comprising guiding moisture from the interior wall segment to the enclosure.

3. The method of claim 1, further comprising guiding moisture from the enclosure to the exterior wall segment.

4. The method of claim 1, further comprising preventing moisture infiltration through the exterior wall segment.

5. The method of claim 1, further comprising selectively activating the venting path.

6. A roof system for a grain storage structure comprising:

at least a portion of a roof including first and second panels, the first and second panels having overlapping segments that together form a structural stiffener, the overlapping segment of the first panel forming a first side wall of the structural stiffener and the overlapping segment of the second panel forming a second side wall of the structural stiffener; and a plurality of vents defined in the first and second side wall segments forming a vapor passage from an interior to an exterior of the grain storage structure through the structural stiffener;

wherein the first and second panels are substantially similar to each other, further wherein the structural stiffener includes a liquid exit opening to the exterior of the grain storage structure and is oriented to cause liquid inside the structural stiffener to exit the structural stiffener through the liquid exit opening.

7. The roof system of claim 6, wherein the structural stiffener is an enclosed channel.

8. The roof system of claim 7, wherein the enclosed channel defines a box-like enclosure.

9. The roof system of claim 6, further comprising a slidable element associated with the structural stiffener, the slidable element operable to selective open and close the vents of the stiffener.

10. The roof system of claim 6, wherein the roof is conical and the panels are radially oriented.

11. The roof system of claim 6, further comprising an additional plurality of panels that are substantially similar to each other define an entire exterior roof surface of the roof system.

12. The roof system of claim 11, wherein the roof is conical and the panels are radially oriented.

* * * * *